US008435316B2

(12) United States Patent
Wu et al.

(10) Patent No.: US 8,435,316 B2
(45) Date of Patent: May 7, 2013

(54) BONDED ABRASIVE ARTICLES AND METHODS OF FORMING

(75) Inventors: Jianhui Wu, Westborough, MA (US); Srinivasan Ramanath, Holden, MA (US); Richard W. J. Hall, Southborough, MA (US); Gilles Querel, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 788 days.

(21) Appl. No.: 12/638,694

(22) Filed: Dec. 15, 2009

(65) Prior Publication Data

US 2010/0154315 A1 Jun. 24, 2010

Related U.S. Application Data

(60) Provisional application No. 61/139,388, filed on Dec. 19, 2008.

(51) Int. Cl.

| | |
|---|---|
| ***B24D 3/14*** | (2006.01) |
| ***B24D 3/18*** | (2006.01) |
| ***C01B 33/12*** | (2006.01) |
| ***C01F 5/06*** | (2006.01) |
| ***C01F 11/04*** | (2006.01) |
| ***C01F 7/30*** | (2006.01) |

(52) U.S. Cl.
USPC ..... 51/308; 51/309; 423/122; 423/158; 423/335; 423/338

(58) Field of Classification Search ..... None
See application file for complete search history.

(56) References Cited

U.S. PATENT DOCUMENTS

| | | | | |
|---|---|---|---|---|
| 3,916,584 | A * | 11/1975 | Howard et al. | 51/308 |
| 5,368,618 | A | 11/1994 | Masmar et al. | |
| 5,378,251 | A | 1/1995 | Culler et al. | |
| 5,492,870 | A * | 2/1996 | Wilcox et al. | 501/80 |
| 5,591,239 | A | 1/1997 | Larson et al. | |
| 5,738,697 | A | 4/1998 | Wu et al. | |
| 6,123,743 | A | 9/2000 | Carman et al. | |
| 2008/0222967 | A1 | 9/2008 | Querel et al. | |

FOREIGN PATENT DOCUMENTS

WO 91/04951 4/1991

OTHER PUBLICATIONS

Seligman et al., Hydrates of aluminium nitrate, 1916, J. Chem. Soc., Trans., 109, pp. 612-617.*

Catauro, M. et al. "Low Temperature Synthesis, Structure and Bioactivity of 2CaO•3SiO2 Glass". Journal of Sol-Gel Science and Technology 10, (1997). pp. 231-237.

(Continued)

*Primary Examiner* — Kaj K Olsen
*Assistant Examiner* — Jared Wood
(74) *Attorney, Agent, or Firm* — Abel Law Group, LLP; Joseph P. Sullivan

(57) ABSTRACT

A method of forming an abrasive article includes forming a mixture comprising a liquid carrier and a glass precursor material, wherein the glass precursor material comprises a material selected from the group of materials consisting of a hydrated metal compound, an organic silicate compound, or a combination thereof. The method further includes providing abrasive grains within the mixture, forming the mixture into a green ceramic body, and heating the green ceramic body to form a bonded abrasive article comprising the abrasive grains contained within a bond matrix, wherein the bond matrix comprises an amorphous phase formed from the glass precursor material.

16 Claims, 2 Drawing Sheets

OTHER PUBLICATIONS

Kwon, Oh-Yun et al. "Preparation of Porous Silica-Pillard Layered Phase: Simultaneous Intercalation of Amine-Tetraethylorthosilicate into the H+-Magadiite and Intragallery Amine-Catalyzed Hydrolysis of Tetraethylorthosilicate". Chem. Mater. vol. 12, No. 5 (2000) pp. 1273-1278.

Saravanapavan P. et al. "Mesoporous calcium silicate glasses. I. Synthesis." Journal of Non-Crystalline Solids 318 (2003) pp. 1-13.

Fu, Yen-Pei et al. "Synthesis and microwave characterization of 2(MgO,Cao)-2AL2O3-5SiO2 glass ceramics from the sol-gel process". Journal of Materials Science 38 (2003) 3081-3084.

Liu, J. et al. "Fabrication of Ultra-fine Diamond Abrasive Tools by Sol-Gel." Materials Science Forum, vol. 471-472 (2004). pp. 426-430.

* cited by examiner

BONDED ABRASIVE ARTICLES AND METHODS OF FORMING

CROSS-REFERENCE TO RELATED APPLICATION(S)

The present application claims priority from U.S. Provisional Patent Application No. 61/139,388, filed Dec. 19, 2008, entitled "Bonded Abrasive Articles and Methods of Forming," naming inventors Jianhui Wu, Srinivasan Ramanath, Richard W. J. Hall, and Gilles Querel, which application is incorporated by reference herein in its entirety.

BACKGROUND

1. Field of the Disclosure

The following is directed to methods of forming bonded abrasive articles, and particularly directed to forming bonded abrasive articles having a glass-ceramic bond via sol-gel processing.

2. Description of the Related Art

Abrasives are generally utilized in various machining operations, ranging from fine polishing to bulk material removal and cutting. For example, free abrasives composed of loose particles are used in slurries for polishing applications such as chemical mechanical polishing (CMP) in the semiconductor industry. Alternatively, abrasives can be in the form of fixed abrasive articles such as bonded and coated abrasives which can include devices such as grinding wheels, belts, rolls, disks and the like.

Fixed abrasives generally differ from free abrasives in that fixed abrasives utilize abrasive grains or grit within a matrix of material that fixes the position of the abrasive grains relative to each other. Within the realm of fixed abrasive tools, generally there are two common types of fixed abrasive tools, coated abrasives and bonded abrasives. Coated abrasive articles generally include a layered article including a backing and an adhesive coat to fix abrasive grains to the backing, the most common example of which is sandpaper. Bonded abrasive tools can take various shapes including wheels, discs, cups, segments, and the like generally consisting of composites having abrasive grains contained within a three-dimensional bond matrix. Additionally, the bonded abrasive tools can include some volume percentage of porosity.

Various materials including metals, polymers, and vitreous materials have been used as the bond material in bonded abrasive tools. However, formation of the tools, particularly with regard to vitreous-based bond materials, has traditionally involved high temperature forming processes, which may present a host of problems, including for example, decomposition of the abrasive grains, non-uniform dispersion of the abrasive grains, cracking, shrinkage, slumping, non-uniform porosity, and the need for specialized starting materials.

Accordingly, the industry continues to need bonded abrasives having improved properties.

SUMMARY

According to a first aspect, a method of forming an abrasive article includes forming a mixture comprising a liquid carrier and a glass precursor material, wherein the glass precursor material comprises a material selected from the group of materials consisting of a hydrated metal compound, an organic silicate compound, or a combination thereof. The method further includes providing abrasive grains within the mixture, forming the mixture into a green ceramic body, and heating the green ceramic body to form a bonded abrasive article comprising the abrasive grains contained within a bond matrix, wherein the bond matrix comprises an amorphous phase formed from the glass precursor material.

In a second aspect, a method of forming an abrasive article includes forming a sol comprising a liquid carrier and a glass precursor material, providing abrasive grains within the sol, and gelling the sol to form a gelled ceramic body. The method further includes heating the gelled ceramic body to form a bonded abrasive article comprising the abrasive grains contained within a bond matrix, wherein the bond matrix comprises an amorphous phase formed from the glass precursor material.

According to another aspect, a method of forming an abrasive article includes forming a mixture comprising a liquid carrier and a glass precursor material selected from the group of materials consisting of aluminum nitrate nonahydrate ($Al(NO_3)_3.9H_2O$), calcium nitrate tetrahydrate ($Ca(NO_3)_2.4H_2O$), magnesium nitrate hexahydrate ($Mg(NO_3)_2.6H_2O$), tetraethylorthosilicate (TEOS), tetramethylorthosilicate (TMOS), and a combination thereof. The method further includes providing abrasive grains within the mixture, forming the mixture into a green ceramic body, and heating the green ceramic body to form a bonded abrasive article comprising the abrasive grains contained within a bond matrix, wherein the bond matrix comprises an amorphous phase formed from the glass precursor material.

According to another aspect, a method of forming an abrasive article includes forming a mixture comprising a liquid carrier and a glass precursor material, wherein the glass precursor material comprises at least one of a nitrate-containing material and an orthosilicate material, providing abrasive grains within the mixture, and forming the mixture into a green ceramic body. The method further includes heating the green ceramic body to a glass forming temperature to form a bonded abrasive article comprising the abrasive grains contained within a bond matrix, wherein the bond matrix comprises an amorphous phase formed from the glass precursor material. The method further includes heating the bonded abrasive article to a sintering temperature to change a portion of the amorphous phase of the bond material to a crystalline phase.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to bonded abrasive articles, and more particularly, methods of forming bonded abrasive articles using a sol-gel processing route. In fact, the bonded abrasive articles herein include a bond matrix material that can be made of a glass (i.e., vitreous) material originally formed from a mixture incorporating a glass precursor material that undergoes chemical reactions of hydration and condensation and is subsequently gelled according to sol-gel processing techniques.

Figure 1:
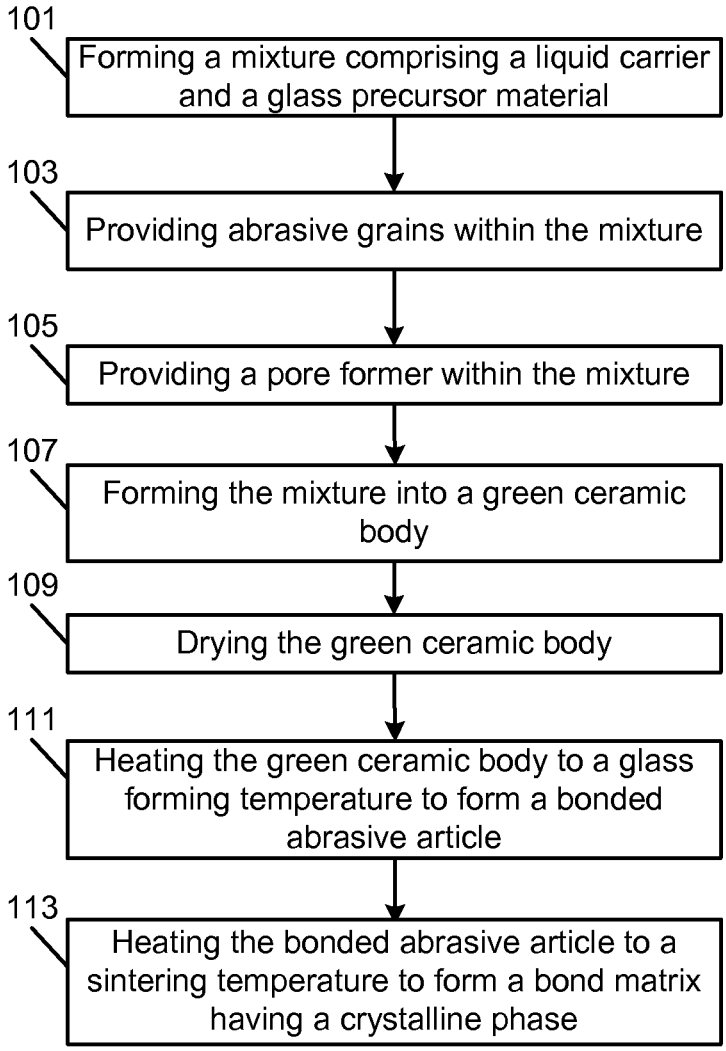
FIG. 1 includes a flowchart illustrating a method of forming a bonded abrasive article in accordance with an embodiment.

FIG. 1 includes a flowchart illustrating a method of forming a bonded abrasive article in accordance with an embodiment. As illustrated, the process is initiated at step 101 by forming a mixture comprising a liquid carrier and a glass precursor material. Formation of the mixture can include the formation of a colloidal suspension or sol, that is, a mixture wherein the glass precursor material contains particles that are dispersed and suspended within the liquid carrier. Such suspensions may be referred to as a colloid, sol or sol-gel mixture, which in certain instances can denote a suspension having particles of a certain size, however reference to a mixture, colloid, sol, or sol-gel herein does not indicate any such particle size limitations.

The glass precursor material is a non-amorphous phase material, such that the glass precursor material includes no amorphous phase material, and is particularly free of frit and fit-containing materials having an amorphous phase. The glass precursor material can include an inorganic material, such as a hydrated metal compound. Suitable inorganic, hydrated metal compounds can include metal nitrate compounds. For example, according to one embodiment, the glass precursor material can include aluminum nitrate nonahydrate ($Al(NO_3)_3.9H_2O$), calcium nitrate tetrahydrate ($Ca(NO_3)_2.4H_2O$), magnesium nitrate hexahydrate ($Mg(NO_3)_2.6H_2O$), or a combination thereof.

In accordance with another embodiment, the glass precursor material can include an organic material. Suitable organic materials may include oxide-containing organic compounds, such as organic silicates. For example, suitable organic silicate glass precursor materials can include tetraethylorthosilicate (TEOS), tetramethylorthosilicate (TMOS), and a combination thereof.

As will be appreciated, the glass precursor material can include a combination of inorganic and organic materials. For example, according to one embodiment, the glass precursor material can include a combination of tetraethylorthosilicate (TEOS) and calcium nitrate tetrahydrate ($Ca(NO_3)_2.4H_2O$). In particular embodiments, the combination of tetraethylorthosilicate and calcium nitrate tetrahydrate can be formed such that the glass precursor material includes at least about 20 wt % calcium nitrate tetrahydrate. In other embodiments, the glass precursor material includes at least about 30 wt %, such as at least about 40 wt %, at least about 50 wt %, or even at least about 60 wt % calcium nitrate tetrahydrate. According to one embodiment the glass precursor material contains an amount of calcium nitrate tetrahydrate within a range between about 20 wt % and about 80 wt %, and more particularly within a range between about 30 wt % and about 60 wt %.

In other embodiments, the glass precursor material includes at least about 30 wt % TEOS. For example, suitable amounts of TEOS can include at least about 40 wt %, at least about 50 wt %, or even at least about 60 wt % of the total weight of the glass precursor material. According to one embodiment the glass precursor material contains an amount of TEOS within a range between about 20 wt % and about 80 wt %, and more particularly within a range between about 30 wt % and about 60 wt %.

As such, for embodiments using a combination of calcium nitrate tetrahydrate and TEOS to form the glass precursor composition, typical ratios of calcium nitrate tetrahydrate to TEOS (calcium nitrate tetrahydrate:TEOS) can include about 50:50 based on the weight of such components within the mixture. In other instances, the ratio is at least 55:45, such as at least about 60:40, at least about 70:30 or even at least about 80:20.

While a combination of glass precursor materials can be combined within the same mixture at the same time, it will be appreciated that separate mixtures of each of the glass precursor materials can first be formed before the separate mixtures are combined into a single mixture. Formation of separate mixtures allows for the proper formation and processing of the separate mixtures before combining the separate mixtures into a single mixture. For example, different processing additives may be added to the separate mixtures, such as the provision of a distinct acid in one mixture, to assure the proper chemical reactions occur, such as hydration and condensation to properly form a sol for gellation.

The amount of glass precursor material within the mixture is generally not greater than about 30 wt % of the total weight of the mixture. In other instances, the amount of the glass precursor material may be less, such as on the order of not greater than about 25 wt %, not greater than about 20 wt %, or not greater than about 15 wt %. Certain embodiments utilize an amount of the glass precursor material within a range between about 5 wt % and about 30 wt %, and more particularly within a range between about 10 wt % and about 30 wt %.

The liquid carrier can include materials suitable for formation of a proper sol. As such, the liquid carrier material can generally include an organic material. For example, in one embodiment, the liquid carrier is water. Water is particularly suitable for suspending the inorganic glass precursor materials within the mixture. In certain instances, other liquid carrier materials may be used, for example, ethanol, alcohol, or a combination thereof. In fact, ethanol may be particularly suitable for forming a mixture wherein the glass precursor materials include organic materials, such as TEOS.

In accordance with particular embodiments, the mixture generally includes at least about 50 wt % of liquid carrier. In other instances, the liquid carrier may be present in amounts such as on the order of at least about 60 wt %, at least about 75 wt %, or even at least about 85 wt %. Certain embodiments utilize an amount of liquid carrier within a range between about 50 wt % and 85 wt % of the total weight of the mixture.

After forming the mixture containing the liquid carrier and the glass precursor material at step 101, the process continues at step 103 by providing abrasive grains within the mixture. As will be appreciated, the provision of abrasive grains within the mixture facilitates the formation of a bonded abrasive article wherein the final article includes abrasive grains that are contained within a bond matrix, such that the tool is suitable for grinding and polishing applications. Notably, the formation of a mixture including abrasive grains processed according to the embodiments herein facilitates the formation of a bonded abrasive article wherein the abrasive grain are uniformly dispersed throughout the bond material.

The abrasive grains typically include hard materials having a Mohs hardness of at least about 7. In other instances, the abrasive grains may include harder materials, having a Mohs hardness of at least about 8, at least about 9, or even about 10. Suitable materials for use as abrasive grains generally include inorganic materials, such as oxides, nitrides, carbides, borides, and a combination thereof. In certain instances, the abrasive grains include superabrasive materials, for example alumina, silicon carbide, cubic boron nitride, diamond, and a combination thereof. In one particular embodiment, the abrasive grains include diamond (natural or synthetic).

It will be appreciated that the abrasive grains can include abrasive grit made of a single material, or alternatively the abrasive grains can be composite material. For example, in one embodiment, the abrasive grains are made of a core that can have a coating substantially surrounding the core. The core material and the coating material can be made of different materials. Such a coating may be suitable for facilitating bonding within the bond matrix during formation of the abrasive article.

The abrasive grains generally have an average particle size of not greater than about 100 microns, such that they are suitable in grinding and polishing of particularly sensitive electronic components. In other instances, the average particle size may be less, such that it is not greater than about 50 microns, not greater than about 25 microns, not greater than about 1 micron, not greater than about 500 nm, not greater than about 250 nm, or even not greater than about 100 nm. According to one particular embodiment, the average particle size of the abrasive grains is within a range between about 100 nm and about 1 micron.

The mixture generally includes a minor amount of abrasive grains, such that they are generally present in an amount of not greater than about 30 wt % of the total weight of the mixture. In other instances, the mixture can include a lesser percentage of abrasive grains, such that it is not greater than about 25 wt %, not greater than about 10 wt %, such as about 15 wt %, about 10 wt %, or even about 5 wt % of the total weight of the mixture. Some embodiments utilize an amount of abrasive grains within a range between about 1 wt % and about 30 wt %, and more particularly within a range between about 5 wt % and about 25 wt %.

After providing the abrasive grains within the mixture at step 103, the method illustrated in FIG. 1 continues at step 105 by further modifying the mixture by providing a pore former therein. Pore formers or pore-inducing materials can be added to the mixture such that the final-formed bonded abrasive article includes a certain percentage and type of porosity. In particular, pore formers can include materials having low volatilization temperatures, such that upon high temperature processing needed to form the bonded abrasive article, such pore forming materials volatilize forming a gas thereby leaving pores behind in the final formed bonded abrasive article. Suitable pore formers can include inorganic or organic materials. Suitable inorganic materials can include oxides or carbon-containing materials, such as graphite. Suitable oxide-containing materials may include glasses, glass-ceramics, ceramics, and a combination thereof. Some suitable organic pore forming materials can include wax, seeds, and shells, sulfosuccinates, naphthalenes, polyvinyls, ketones, polystyrenes, polyethylenes, polypropylenes, acrylics, benzene-containing polymers, alkyds, polyalkydes, epoxies, phenolics, acetals, and a combination thereof. Suitable inorganic pore formers can include hollow particles, such as beads, spheres, or the like made of materials such as glass, ceramics, glass-ceramics, or a combination thereof. Other inorganic pore-forming materials can include salts such as such as sodium chloride, potassium chloride, magnesium chloride, calcium chloride, sodium silicate, sodium carbonate, sodium sulfate, potassium sulfate, magnesium sulfate, and the like, and a combination thereof.

The pore formers can have particle sizes suitable for forming the desired porosity within the final-formed bonded abrasive article. In accordance with embodiments herein, the pore formers may include particularly small particles. As such, in one particular embodiment, the pore former includes a particulate material having an average particle size of not greater than about 0.5 mm. In other instances, the particle size is smaller, such as not greater than about 250 microns, such as not greater than about 100 microns, or even not greater than about 50 microns, and particularly within a range between about 10 microns and about 500 microns.

The formation of a mixture including well-dispersed pore formers facilitates the formation of a final-formed bonded abrasive article having well-dispersed porosity. Moreover, control of the size and morphology of pore formers facilitates control of the size, uniformity, and nature (i.e., open or closed) of the porosity within the final-formed bonded abrasive product.

The amount of pore formers within the mixture may depend upon the desired porosity in the final-formed abrasive article. According to particular embodiments herein, the mixture can contain a minor amount of such pore formers such as not greater than about 40 vol % of the total volume percent of the mixture. Other embodiments can use lesser amounts, such as not greater than about 30 vol %, not greater than about 25 vol %, not greater than about 20 vol % or even not greater than about 10 vol %. Particular embodiments utilize an amount of pore formers within a range between about 5 vol % and about 40 vol % of the total weight of the mixture.

In addition to the provision of pore formers within the mixture, it will be appreciated that the mixture can include other materials for forming a suitable colloidal mixture, such as dispersants, binders, and the like. Generally, the mixture includes minor amounts of such additives. For example, the mixture can include a binder such as a glycol, dextrin, resin, glue or alcohol, or combinations thereof, which is generally present in amounts of not greater than about 10 wt %, and even not greater than about 5 wt %. Some suitable dispersants can include methanol, ethanol, propanol, butanol, and the like, which can be present in amounts similar to those of other additives, like the binder.

Referring again to FIG. 1, after providing the pore formers within the mixture at step 105, the process can continue at step 107 by forming the mixture into a green ceramic body. In particular, the processing described herein follows a sol-gel processing route, which includes hydrolysis and condensation of the glass precursor material followed by gellation to form a green ceramic article. Formation of a gel with regard to sol-gel processing is understood to include evolution of the species within the sol towards to formation of a continuous network with a liquid phase. The gel is characterized by the formation of bridging oxygens or hydroxide compounds between metal elements, thereby forming metal-oxo or metal-hydroxo chains or "polymers". Gelling provides a green ceramic article that has sufficient strength for handling. Notably, the forming process can also include a shaping process wherein the gel is shaped to the desired final form of the article. The sol-gel process is distinct from conventional forming methods in that traditional forming methods rely upon formation of a mixture of components that do not undergo the hydrolysis and condensation reactions noted above, much less a gelling process.

As such, in accordance with one embodiment, the forming process includes a gelling process, which can include an aging process wherein the colloid is set for a duration. Typically, the aging process is carried out for a duration of at least about 5 hours, such as at least about 10 hours, at least about 25 hours, at least about 40 hours, or even at least about 50 hours. Certain embodiments utilize an aging process having a duration within a range between about 5 hours and 50 hours.

Additionally, it will be appreciated that the gelling process can include the application of heat to facilitate the gelling process. In such instances where heat is applied to facilitate the gelling process, low temperatures are used, such as on the order of 80° C. or less.

Moreover, gelling of the mixture may be facilitated by the provision of a gelling agent. The gelling agent may be a pH modifying species, such as an acid or base capable of changing the pH of the mixture to initiate the gelling process. In accordance with an embodiment, the gelling agent can include materials such as hydrochloric acid, sulfuric acid, nitric acid, sodium hydroxide, potassium hydroxide, ammonia, or a combination thereof. Generally, the mixture contains a minor amount of gelling agents such as not greater than about 5 wt %. Other embodiments may utilize less of the gelling agents, depending upon the desired pH, such that the amount of gelling agent is not greater than about 3 wt % or even not greater than about 1 wt %.

In additional to the gelling process, the forming process can further include a shaping process wherein the gelled mixture is shaped such that the final-formed bonded abrasive article has a shape suitable for use. In accordance with an embodiment, the forming process includes a molding process wherein the mixture is poured and gels within a molded form.

After forming the mixture at step 107, the process continues at step 109 by drying the green ceramic body. The drying process is typically conducted to remove excess water and any low-volatility organics, while providing the green ceramic body with sufficient mechanical integrity for handling. Generally, drying is carried out at a drying temperature of not greater than about 500° C. In fact, other embodiments may utilize lower drying temperatures, such that drying is carried out at a drying temperature of not greater than about 400° C., not greater than about 300° C., not greater than about 200° C., not greater than about 150° C., not greater than about 100° C., or even not greater than about 90° C. Certain embodiments utilize a drying temperature within a range between about 60° C. and about 200° C.

Drying can be carried out for a drying duration suitable to remove substantially all of the excess liquid and other low volatility organic materials which may be contained within the green ceramic body. As such, the drying process typically allows for a drying duration of at least about 5 hours, and more particularly, on the order of at least about 10 hours, at least about 15 hours, or even at least about 20 hours. Particular embodiments utilize a drying duration within a range between about 5 hours and 20 hours.

After the green ceramic body is sufficiently dried, the process can continue at step 111 by heating the green ceramic body to a glass forming temperature to form a bonded abrasive article. In particular, the process of heating to the glass forming temperature facilitates the formation of a bond matrix including a glass material having an amorphous phase of sufficient rigidity and strength suitable for use as an abrasive tool. In particular, the heat treatment process uses a particularly low glass forming temperature, for example, a temperature of not greater than about 1000° C. In other instances, the glass forming temperature may be less, such as not greater than about 900° C., not greater than about 800° C., about 700° C., about 600° C., or even about 500° C. Particular embodiments utilize a glass forming temperature between about 400° C. and about 1000° C.

The heat treatment process at the glass-forming temperature is conducted such that the bond matrix is formed to have a glass material with an amorphous phase. As such, the ceramic body can be held at the glass-forming temperature for a glass forming duration of at least about 60 minutes. In other embodiments the duration at the glass forming temperature may be greater, such as at least about 2 hours, at least about 4 hours, at least about 8 hours, and typically within a range between about 1 hour and 10 hours.

Moreover, the heating process is conducted to form a bond matrix including a glass material, and accordingly the bonded abrasive article is cooled from the glass forming temperature at a rate suitable for maintaining the amorphous phase content within the bond. As such, in accordance with one embodiment, the bonded abrasive article is cooled at a rate of at least about 1° C./min from the glass forming temperature. The cooling rate can be greater in some cases, such as at least about 2° C./min, at least about 4° C./min, at least about 6° C./min, or even at least 8° C./min. The cooling rate may not exceed about 10° C./min depending upon the article to avoid excessive thermal stress on the article. Alternatively, natural cooling procedures may be utilized in which the bonded abrasive article I maintained within the heated environment (e.g., furnace) and the heating elements are turned off, and the environment is allowed to cool at a natural rate.

Referring again to FIG. 1, after heating the green ceramic body to form the bonded abrasive article, and more particularly, after cooling from the glass forming temperature, the bonded abrasive article may undergo a second, optional heating process. At step 113 the bonded abrasive article may undergo heating at a sintering temperature to form a bond matrix having a crystalline phase. In accordance with one particular embodiment, the second optional heating process may be suitable to convert a portion of the amorphous phase material within the bond matrix to a crystalline phase material. As such, the second heating process is generally conducted at temperatures greater than the first heating process of step 111, and in particular can be conducted at a sintering temperature suitable for facilitating grain growth and densification of the bond material. For example, suitable sintering temperatures can be at least 650° C., such as at least about 750° C., at least about 850° C., about 950° C., or even at least about 1200° C. Particular embodiments utilize sintering temperatures within a range between about 850° C. and 1300° C.

The process of heating at the sintering temperature can be carried out for a sintering duration of at least about 60 minutes, such as at least about 75 minutes, at least about 90 minutes, at least about 120 minutes, or even about 360 minutes. The sintering time may not exceed about 500 minutes in certain embodiments.

Moreover, as will be appreciated, after a suitable sintering duration at the sintering temperature, the bonded abrasive article can be cooled from the sintering temperature at a controlled rate to maintain the crystalline phase formed by the sintering process and avoid excess thermal stresses to the body. As such, in accordance with one embodiment, the bonded abrasive article is cooled at a rate of not greater than about 10° C./min, such as on the order of not greater than about 8° C./min, not greater than about 6° C./min, or even not greater than about 4° C./min. The cooling rate can be within a range between about 1° C./min and about 10° C./min.

Accordingly, upon finishing the process as described in accordance with FIG. 1, the result is a bonded abrasive article having abrasive grains contained within a bond matrix, wherein the entire bonded abrasive article is formed through a sol-gel, or colloidal-based processing route. That is, in particular, the bonded abrasive article is formed from an initial colloidal mixture including a glass precursor material having no amorphous phase content (e.g., fit-containing material) that is capable of undergoing an inorganic polymerization reaction transformation to form a metal oxide compound that can be converted to a glass material having some amorphous phase content. Such a process facilitates the formation of a bonded abrasive article, wherein the abrasive grains are uniformly distributed throughout the bond matrix and the porosity is particularly well controlled in terms of placement, nature, and uniformity of pores.

In accordance with particular embodiments herein, the final-formed bonded abrasive article can have a porosity of at least about 5 vol % of the total volume of the bonded abrasive article. In other embodiments, the porosity can be greater, such as on the order of at least about 15 vol %, at least 25 vol %, at least about 25 vol %, at least about 50 vol %, or even at least about 60 vol %. Particular embodiments utilize a range of porosity between about 5 vol % and about 75 vol % of the total volume of the bonded abrasive article.

Moreover, the bond matrix material of the bonded abrasive article can be formed to have particular glass phase (i.e., amorphous phase) and crystalline phase content. For example, the bond matrix material can include at least about 10 wt % of a glass material. In other instances, the bond matrix material can include at least about 30 wt % glass material, such as at least about 40 wt %, at least about 50 wt % or even at least about 60 wt % glass material for the total weight of the bond material. In particular, the bond matrix material can include a glass material content within a range between about 10 wt % and about 90 wt %.

Additionally, a portion of the bond matrix material can include a crystalline phase material. For example at least about 10 wt % crystalline phase for the total weight of the bond material. In other instances, the bond matrix material can include a greater amount of crystalline phase, such that it is present in an amount of at least about 30 wt %, at least about 40 wt %, at least about 50 wt %, at least about 60 wt %, or even at least about 70 wt %. In accordance with one particular embodiment, the bond material comprises a crystalline phase within a range between about 10 wt % and about 90 wt % of the total weight of the bond material.

Embodiments herein facilitate the formation of bond matrix materials incorporating oxide-containing compounds of silicon, aluminum, lithium, calcium, sodium, potassium, magnesium, boron, and phosphorus.

Figure 2:
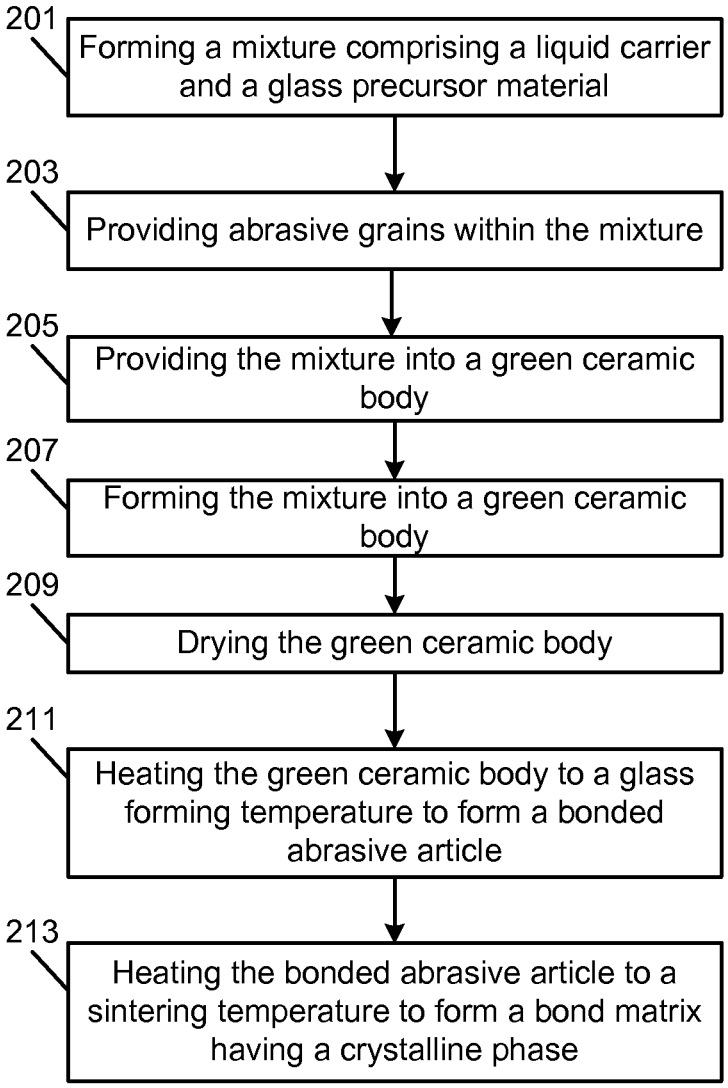
FIG. 2 includes a flowchart illustrating an alternative method for forming a bonded abrasive article in accordance with an embodiment.

FIG. 2 includes a flowchart illustrating an alternative method for forming a bonded abrasive article in accordance with an embodiment. In particular, the process illustrated in FIG. 2 includes a process for forming a foamed bonded abrasive article in accordance with an embodiment. In particular, the foamed abrasive article, includes a bonded abrasive article having a high content of porosity generally exceeding 60 vol % porosity for the total volume of the bonded abrasive article. More particularly, the nature of the porosity with the foamed bonded abrasive article is a majority of open porosity such that the porosity defines an interconnected network of channels extending through the body of the foamed bonded abrasive article. The provision of such porosity facilitates the penetration of water and other liquids during a grinding process as well as swarf removal.

As illustrated in FIG. 2, the process is initiated in the same manner at steps 201 and 203, as previously described in accordance with the process of FIG. 1. At step 205 the process includes the step of providing a foaming agent within the mixture. Provision of the foaming agent facilitates the formation and volatilization of gas, especially during agitation or mixing of the mixture, such that the formation of a foamed abrasive article having a high degree of porosity is possible. Suitable foaming agents can include organic or inorganic materials, which can include cationic, anionic, non-ionic, or even amphoteric species. According to a particular embodiment, the foaming agent can include organic compositions, including for example, azo compounds, polysiloxanes, polyvinyl alcohol, and carbamide (urea), or the like. Some inorganic foaming agents can include carbonates, phosphates, and hydride-containing compounds, such as calcium carbonate, calcium phosphate, ammonium hydrogen carbonate, and titanium dihydride.

The mixture can contain a minor amount of a foaming agent. For example, the foaming agent can be present within the mixture in amounts of not greater than about 5 wt % of the total weight of the mixture. In other embodiments, the amount of the foaming agent can be less, such as not greater than about 4 wt %, not greater than about 3 wt %, not greater than about 2 wt %, and particularly within a range between about 0.1 wt % and about 3 wt %.

Additionally, it will be appreciated that while the process is described generally as adding the foaming agent to the mixture, it will be appreciated that the foaming agent can be made first as a separate mixture that can be added to the mixture containing the liquid carrier and glass precursor material in a separate step upon desired initiation of foaming. For example, a first mixture may be made that includes the liquid carrier, glass precursor material, and abrasive grains. Another mixture may be made separately that includes the foaming agent as well as other additives, such as a gelling agent, stabilizer, and liquid carrier. Such mixtures may be processed separately before being combined, for example, the mixture containing the foaming agent may be agitated or mixed such that foaming occurs to a certain extent before the mixture containing the liquid carrier, glass precursor material, and abrasive grains are added. Upon combining the mixtures, a foamed mixture exists including all of the components combined. After providing the foaming agent within the mixture at step 205, the process continues at steps 207 through 213, which includes the same processes as described in accordance with FIG. 1 in corresponding steps 107 through 113.

Accordingly, upon completion of the process as illustrated in FIG. 2, the foamed bonded abrasive article can have a high degree of porosity. In fact, the foamed article can include a high degree of open porosity defining a network of interconnected channels extending through the bonded abrasive body. Such a process is suitable for forming a foamed bonded abrasive article having porosities in excess of 60 vol %. More particularly, the porosity of such foamed bonded abrasive articles can be at least about 65 vol %, such as at least about 70 vol %, at least about 75 vol %, or even at least about 80 vol %. Certain embodiments have a porosity within a range between about 60 vol % and about 85 vol %.

Because of the nature of the foamed bonded abrasive article, at least about 50 vol % of the total volume of porosity can be open porosity. Other embodiments can have a greater percentage of open porosity, such as on the order of at least about 60 vol %, at least about 75 vol %, at least about 80 vol %, or even at least about 90 vol % of the total volume of porosity. Particular bonded abrasive articles have a percentage of open porosity within a range between about 50 vol % and about 95 vol %.

EXAMPLES

A bonded abrasive article was formed from a mixture according to the following process. A first mixture was formed including 60 ml of deionised water and 14 grams of calcium nitrate tetrahydrate ($Ca(NO_3)_2.4H_2O$). The first mixture further included 10 ml of a 7% nitric acid solution as a gelling agent. A second mixture was prepared that included 60 ml of deionised water and 12 ml of TEOS. The first and second mixtures were combined and mixed together. After the formation of the mixture, 2 wt % of diamond grains commercially available from Diamond Innovation Company having an average particle size of 1-3 microns were added to the mixture.

Upon forming the mixture including the abrasive grains and pore formers the mixture was gelled and dried. Gelling included aging the mixture for 48 hours in a dry environment at a temperature of 65° C. Provision of the nitric acid solution within the original mixture assisted the gelling process. The gelling process was completed in a mold such that the dried article (green ceramic body) took the shape of the mold.

After gelling and drying, the green ceramic body was heat treated at a glass forming temperature of 800° C. for a duration of 2 hours to form a bond matrix material having a particular amorphous phase content. After a suitable duration at the glass forming temperature the ceramic body was cooled by means of a natural cooling process to maintain the amorphous phase content obtained during heat treatment. After cooling the bond matrix material had a particular crystalline phase content.

The methods of forming the bonded abrasive articles described herein represent a departure from the state-of-the-art. Traditionally, bonded abrasive articles having a glass or glass-ceramic bond matrix are formed from a mixture that initially contains frit or glass-containing material necessary for formation of a vitreous bond in the final-formed bonded abrasive article. The embodiments herein, however, utilize a glass precursor material that is characterized by having no amorphous phase content. In particular, the glass precursor materials are inorganic nitrate salts or organic orthosilicate materials that are provided within a suspension, that may be combined with other components such as binders, pore formers, abrasive grains, and even foaming agents, and heat treated in such a manner to facilitate chemical synthesis characterized by the sol-gel process. Such a process includes hydrolysis and condensation reactions to facilitate the formation of a gel characterized by metal-oxo or metal-hyrdoxo bonds. As such, the formation of bonded abrasive articles according to the processes herein can be accomplished at lower temperatures than those utilized in conventional processing methods. Moreover, the methods and processes described herein facilitate the formation of bonded abrasive articles having a uniform distribution of abrasive grains within the bond material, a bond matrix material having greater homogeneity via greater uniformity in the distribution of non-bridging oxygens, and more controlled and uniform distribution of porosity.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A method of forming an abrasive article comprising:

forming a mixture comprising a liquid carrier and a glass precursor material, wherein the glass precursor material comprises a material selected from the group of materials consisting of, an organic silicate compound, or a combination of an organic silicate compound and a hydrated metal compound;

providing abrasive grains within the mixture;

forming the mixture into a green ceramic body; and heating the green ceramic body to form a bonded abrasive article comprising the abrasive grains contained within a bond matrix, wherein the bond matrix comprises an amorphous phase formed from the glass precursor material, wherein the organic silicate material comprises an orthosilicate.

2. The method of claim 1, further comprising gelling the mixture.

3. The method of claim 1, further comprising providing a foaming agent to the mixture.

4. The method of claim 1, wherein heating the green ceramic body comprises heating the green ceramic body to a glass forming temperature of not greater than about 1000° C. to form a bonded abrasive article comprising the bond matrix including an amorphous phase.

5. The method of claim 4, wherein heating further comprises heating the bonded abrasive article to a sintering temperature to form a bond material comprising a crystalline phase and an amorphous phase.

6. The method of claim 5, wherein the sintering temperature is at least about 650° C.

7. The method of claim 1, wherein the hydrated metal compound comprises a metal nitrate compound.

8. The method of claim 7, wherein the metal nitrate compound comprises a material selected from the group of materials consisting of aluminum nitrate nonahydrate ($Al(NO_3)_3.9H_2O$), calcium nitrate tetrahydrate ($Ca(NO_3)_2.4H_2O$), magnesium nitrate hexahydrate ($Mg(NO_3)_2.6H_2O$), and a combination thereof.

9. The method of claim 1, wherein the organic silicate material comprises a material selected from the group of materials consisting of tetraethylorthosilicate (TEOS), tetramethylorthosilicate (TMOS), and a combination thereof.

10. The method of claim 1, wherein the amorphous phase comprises at least about 10 wt % of the total weight of the bond matrix.

11. The method of claim 1, wherein the bond matrix includes a crystalline phase comprising at least about 10 wt % of the total weight of the bond matrix.

12. The method of claim 1, wherein the bonded abrasive article is a foamed abrasive article comprising abrasive grains contained within a bond matrix, wherein the foamed abrasive article has a porosity of at least about 60 vol %, and the majority of the porosity is open porosity defining an interconnected network of channels extending through the foamed abrasive article.

13. A method of forming an abrasive article comprising:

forming a mixture comprising a liquid carrier and a glass precursor material;

providing abrasive grains within the mixture;

forming the mixture into a green ceramic body; and heating the green ceramic body to form a bonded abrasive article comprising the abrasive grains contained within a bond matrix, wherein the bond matrix comprises an amorphous phase formed from the glass precursor material, wherein the glass precursor material comprises a combination of calcium nitrate tetrahydrate ($Ca(NO_3)_2.4H_2O$) and tetraethylorthosilicate (TEOS).

14. The method of claim 13, wherein the glass precursor material comprises an amount of tetraethylorthosilicate (TEOS) of at least about 20 wt %.

15. A method of forming an abrasive article comprising:

forming a mixture comprising a liquid carrier and a glass precursor material, wherein the glass precursor material comprises a material selected from the group of materials consisting of a hydrated metal compound, an organic silicate compound, or a combination thereof;

providing abrasive grains within the mixture;

forming the mixture into a green ceramic body; and heating the green ceramic body to form a bonded abrasive article comprising the abrasive grains contained within a bond matrix, wherein the bond matrix comprises an amorphous phase formed from the glass precursor material, wherein the bond matrix includes a crystalline phase comprising at least about 10 wt % of the total weight of the bond matrix.

16. A method of forming an abrasive article comprising:

forming a mixture comprising a liquid carrier and a glass precursor material, wherein the glass precursor material comprises a material selected from the group of materials consisting of a hydrated metal compound, an organic silicate compound, or a combination thereof;

providing abrasive grains within the mixture;

forming the mixture into a green ceramic body; and heating the green ceramic body to form a bonded abrasive article comprising the abrasive grains contained within a bond matrix, wherein the bond matrix comprises an amorphous phase formed from the glass precursor material, wherein the bonded abrasive article is a foamed abrasive article comprising abrasive grains contained within a bond matrix, wherein the foamed abrasive article has a porosity of at least about 60 vol %, and the majority of the porosity is open porosity defining an interconnected network of channels extending through the foamed abrasive article.

* * * * *

UNITED STATES PATENT AND TRADEMARK OFFICE

CERTIFICATE OF CORRECTION

PATENT NO. : 8,435,316 B2
APPLICATION NO. : 12/638694
DATED : May 7, 2013
INVENTOR(S) : Jianhui Wu et al.

It is certified that error appears in the above-identified patent and that said Letters Patent is hereby corrected as shown below:

In the Claims

Claim 1, Column 12, line 2, delete “of, an” and insert therefor --of an--

Signed and Sealed this
Twenty-first Day of October, 2014

Michelle K. Lee

Michelle K. Lee
*Deputy Director of the United States Patent and Trademark Office*